US005741387A

United States Patent [19]

Coleman

[11] Patent Number: 5,741,387

[45] Date of Patent: Apr. 21, 1998

[54] LITHOGRAPHIC PRINTING PROCESS AND TRANSFER SHEET

[75] Inventor: Kenneth R. Coleman, Palm Beach Gardens, Fla.

[73] Assignee: Riverside Industries, Inc., Palm Beach Gardens, Fla.

[21] Appl. No.: 515,411

[22] Filed: Aug. 15, 1995

[51] Int. Cl.[6] ..... B41M 5/40

[52] U.S. Cl. ..... 156/240; 156/277; 428/195; 428/211; 428/913; 428/914

[58] Field of Search ..... 156/239, 240, 156/277; 428/195, 913, 914, 412, 423.1, 473, 474.4, 480, 484, 500, 516, 532

[56] References Cited

U.S. PATENT DOCUMENTS 5,312,683 5/1994 Chou et al. ..... 428/328

*Primary Examiner*—Bruce H. Hess

*Attorney, Agent, or Firm*—Oblon, Spivak, McClelland, Maier & Neustadt, P.C.

[57] ABSTRACT

A laminated image transfer sheet, having a backing sheet, a heat release layer on said backing sheet, an ink design layer on said heat release layer, a polymer layer containing a water-dispersible polymer on said ink design layer and a lacquer mask layer on said polymer layer, is used in a dry heat transfer process to transfer an ink design to a substrate.

19 Claims, 3 Drawing Sheets

LITHOGRAPHIC PRINTING PROCESS AND TRANSFER SHEET

BACKGROUND OF THE INVENTION

1. Field of the Invention

The invention relates to a heat transfer printing process and to a transfer sheet used in the process. More particularly, the invention is directed to a transfer sheet having a backing, a polymer barrier or release layer, an image ink layer, an aqueous polymer overcoat layer and a lacquer blocking mask layer.

2. Description of the Background

The transfer of images from a backing sheet onto a substrate has been known and used for many years. Image transfer sheets, sometimes called decalcomania or decals, are generally of two types, i.e., dry heat release transfer sheets and wet release transfer sheets. The transfer sheets are generally multilayer structures having a backing sheet, a barrier or release layer, ink layers and one or more adhesive layers. Wet release and dry release transfer sheets require different barrier or release layers and different adhesive layers suitable for wet transfer or, alternatively, dry heat transfer processes. For example, backing sheets for dry heat release have traditionally been coated with a polymer or silicone heat release layer. In contrast, backing sheets for wet release transfer sheets are generally coated with a water soluble material.

U.S. Pat. No. 705,590 and U.S. Pat. No. 2,558,803 are early U.S. patents directed to wet transfer sheets or decals. Over many years, wet printed transfer sheets have been improved by the discovery of new adhesive layers, new barrier layers, etc. U.S. Pat. No. 4,399,178, U.S. Pat. No. 5,098,772, U.S. Pat. No. 5,229,201 and U.S. Pat. No. 5,328,535 disclose improved wet transfer sheets.

Transfer sheets which contain pressure-sensitive adhesive layers or self-adhering adhesive layers are also known. U.S. Pat. No. 4,028,474, U.S. Pat. No. 4,044,181, U.S. Pat. No. 4,211,810 and U.S. Pat. No. 5,284,688 are representative examples of self-adhering and/or pressure sensitive transfer materials.

Dry heat transfer materials have also been known for many years. Generally, heat transfer sheets employ a thermoplastic polymer or heat softening varnish or lacquer as a top adhesive layer for bonding the transferred image to the substrate. U.S. Pat. No. 2,154,198, U.S. Pat. No. 3,065,120, U.S. Pat. No. 3,894,167, U.S. Pat. No. 3,920,499, U.S. Pat. No. 3,922,435, U.S. Pat. No. 4,037,008, U.S. Pat. No. 4,038,123, U.S. Pat. No. 4,068,033, U.S. Pat. No. 4,107,365, U.S. Pat. No. 4,303,717, U.S. Pat. No. 4,391,853, U.S. Pat. No. 4,068,033, U.S. Pat. No. 4,445,432, U.S. Pat. No. 4,117,182, U.S. Pat. No. 4,292,104, U.S. Pat. No. 4,322,467, U.S. Pat. No. 4,610,904 and U.S. Pat. No. 5,104,719 disclose various heat transfer sheets employing numerous types of adhesive layers, intermediate layers and release layers.

A continuing problem with dry heat transfer materials is the loss of "hand" or the formation of hard or brittle images on the substrate. Over a time, these image layers crack, chip and peel from the substrate severely reducing the esthetic appeal of the transfer image. For example, images prepared by conventional screen printing followed by dry heat transfer to a cloth substrate frequently crack and peel from the substrate with repeated laundering.

Additionally, polymer layers used to prepare laminate transfer sheets are frequently transferred to the substrate itself during dry heat transfer. The transferred polymeric materials also reduce the "hand" of the image printed substrate and often produce a halo of clear polymer around the transferred image. The transferred polymer halo detracts from the imaged substrate by reducing the sharpness and clarity of the transferred image.

The prior art has attempted to solve the polymer halo problem by applying an adhesive polymer or adhesive varnish over an image and in close register to the image. During heat transfer, the polymer or adhesive varnish covering the image bonds the image to the substrate only within the outline of the image thereby substantially eliminating the polymer halo. U.S. Pat. No. 209,952, U.S. Pat. No. 3,959,555, U.S. Pat. No. 4,308,310 and U.S. Pat. No. 4,517,044 described different ways to achieve this result. Although these processes minimize the polymer halo, the transferred image remains susceptible to cracking and peeling. U.S. Pat. No. 4,786,349 describes a heat transfer process in which an absorbing sheet is used between a heated platen and a thermoplastic layer having characters printed thereon. The absorbing sheet has a greater affinity for softened or molten thermoplastic adhesive of the thermoplastic sheet and absorbs the heated adhesive, thereby minimizing the polymer halo transferred to the substrate. This method also, however, does not prevent the transferred image from cracking and peeling.

Although image transfer sheets have been known since the late 1800's, there continue to exist the problems associated with clearly transferring an image to a substrate and the "hand" or feel or the substrate after the image has been transferred. A need continues to exist for an improved transfer sheet and process of dry heat transfer of images to substrates.

SUMMARY OF THE INVENTION

One object of the present invention, therefore, is to provide a heat transfer sheet and heat transfer process for clearly transferring an image to a substrate.

A further object is to provide a heat transfer process for transferring an image to a textile substrate in which the image is clearly transferred to the textile substrate and, additionally, the resulting textile article has a soft hand or feel.

These and other objects which will become apparent from the following detailed description have been achieved by the laminated image transfer sheet of the invention which contains:

- a backing sheet;
- a heat release layer on said backing sheet;
- an ink design layer on said heat release layer;
- a polymer layer containing a water-soluble or water-dispersible polymer on said ink design layer; and
- a mask layer on said polymer layer, wherein said mask layer outlines an ink design in the ink design layer, but does not cover the ink design and allows transfer of only the heat release layer, the ink design and the polymer layer within the outlined ink design, and a process of dry image transfer using this transfer sheet.

DETAILED DESCRIPTION OF THE PREFERRED EMBODIMENTS

Figure 1:
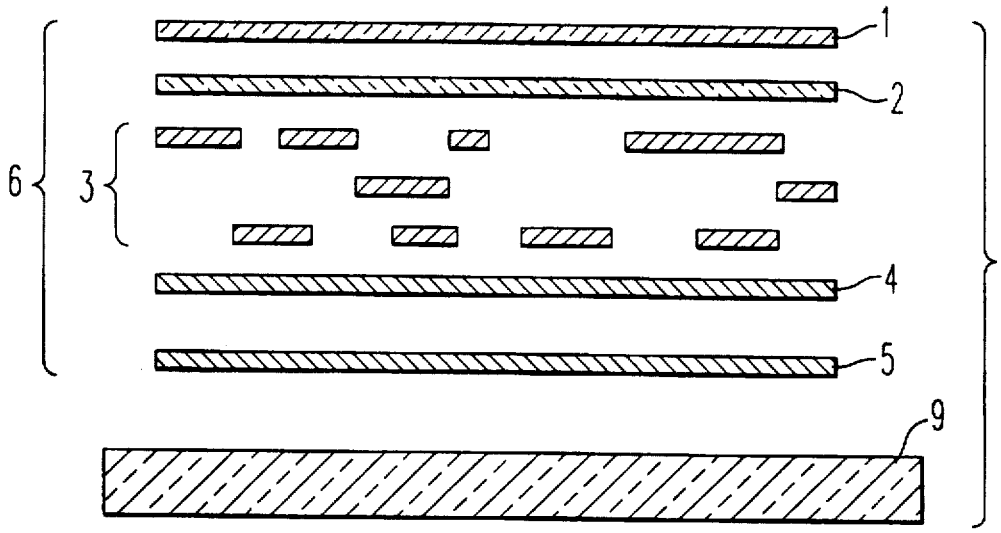
FIG. 1 is a side sectional view of the laminated image transfer sheet of the invention.

FIG. 1 illustrates the laminated image transfer sheet 6 of the invention which includes a backing sheet 1 having thereon a release layer 2. An ink design is printed on the release layer 2 to form ink design layer 3. A polymer layer 4 is formed over the ink design layer and a mask layer 5 is disposed over the polymer layer such that the mask layer outlines one or more ink designs in the ink design layer covering the entire polymer layer but not the ink designs within the outline formed by the mask layer.

In a process for heat transferring the ink designs from the image transfer sheet to a substrate 9, the substrate is placed in contact with the mask layer and heat is applied through the backing layer, whereupon polymer layer 4, ink design layer 3 and heat release layer 2, within the outline formed by the mask layer, are thermally transferred through the mask onto and/or into the substrate. During the transfer process, the mask becomes bonded to the polymer layer preventing transfer of polymer layer, ink design layer and heat release layer underlying the mask. This transfer process results in the transfer of an ink design having a clear outline which is coincident with the outline of the heat transferred polymer layer and heat release layer. Since heat transfer occurs through the mask only, no polymer halo is formed on the substrate.

Figure 2:
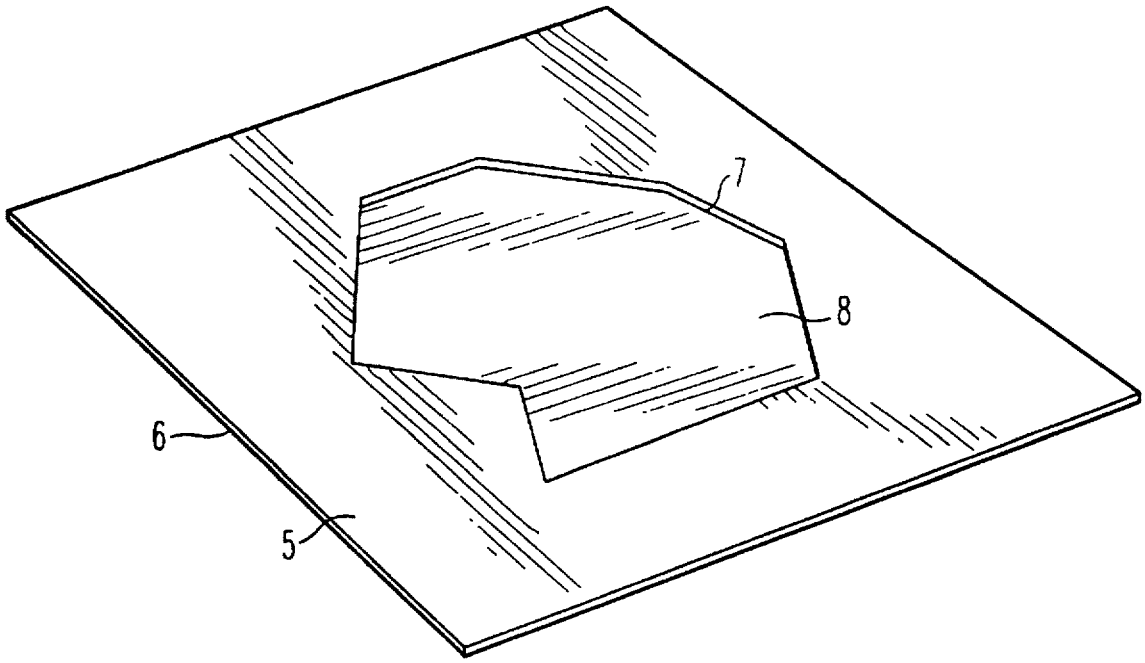
FIG. 2 is a top plan view of the laminated image transfer sheet showing the mask layer outlining an ink design on the ink design layer, but not covering the ink design.

FIG. 2 shows the image transfer sheet 6 of the invention in which mask layer 5 forms an outline 7 around an ink design 8. The portion of the polymer layer, ink design layer and heat release layer not covered by the mask layer, that is, the portion of these layers within outline 7 are transferred to the substrate during the heat transfer process. The remaining portion of the polymer layer, ink design layer and heat release layer underlying the mask layer are not transferred during the heat transfer process.

Figure 3:
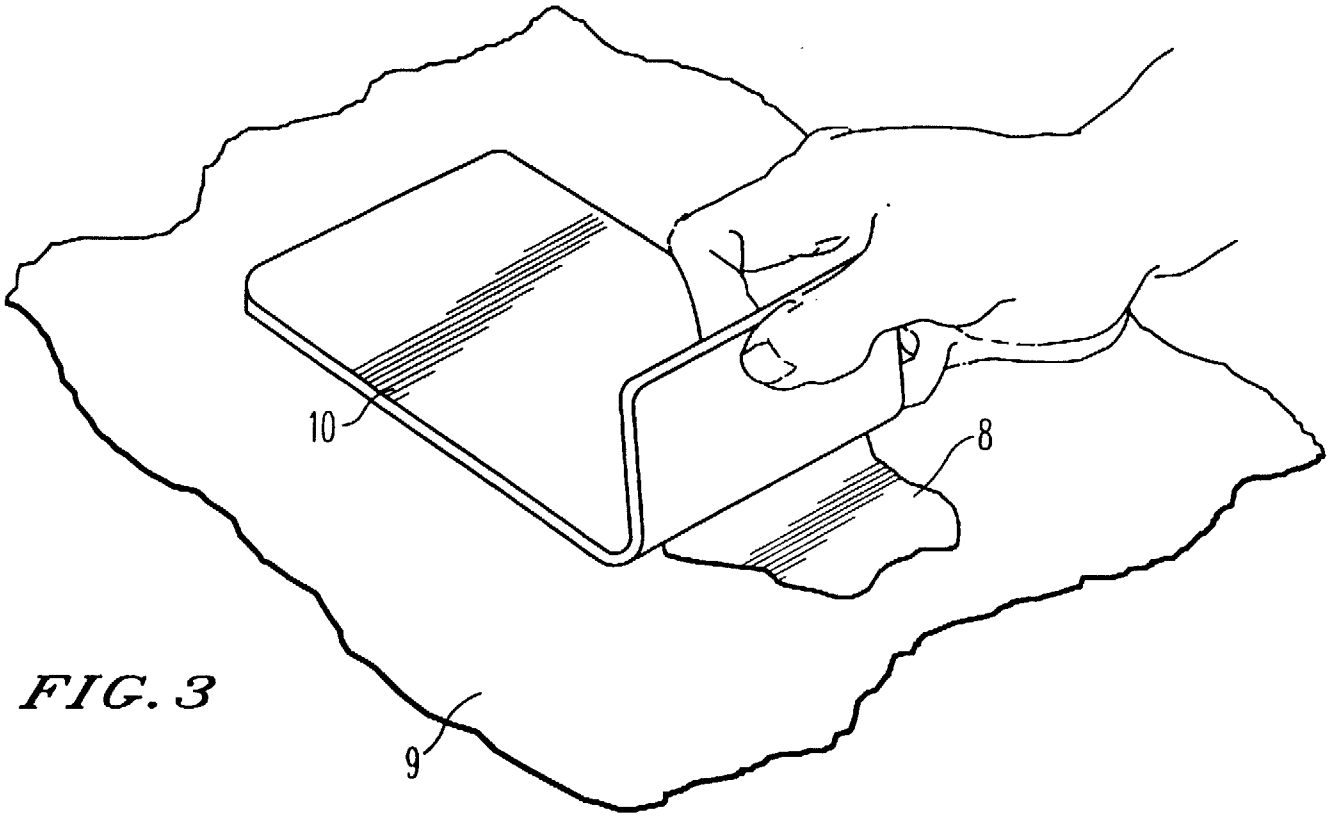
FIG. 3 illustrates the application of an ink design to a substrate using the image transfer sheet of the invention.

FIG. 3 illustrates the use of the image transfer sheet of the present invention. The image transfer sheet is placed in contact with the substrate such that the mask layer is in contact with the substrate. Application of heat through the exposed backing layer transfers polymer layer 4, ink design layer 3 and heat release layer 2 from the image transfer sheet to the surface of the substrate and fuses the mask layer to the underlying polymer layer, ink layer, heat transfer layer and backing sheet forming a used or expended sheet 10. Removal of the expended sheet 10 from the surface of substrate 9 reveals the transferred ink design 8 on the surface of substrate 9.

The backing sheet 1 is a thin flexible, but non-elastic carrier sheet upon which the release layer can be formed and serves as a support for the production of an image on the transfer sheet and from which the image can be released. The backing sheet is not particularly limited and may be any conventional backing sheet which is suitably flexible and upon which the heat release layer, ink design layer, polymer layer and mask layer can be formed. Typically, the backing sheet is a paper web, plastic film, metal foil, wood pulp fiber paper, vegetable parchment paper, lithographic printing paper or similar material.

The backing sheet may be impregnated with a reactive non-staining non-thermosetting polymer as a binder to provide improved tensile strength to the backing sheet. Suitable polymers include acrylic polymers which are contained in the product designated HYCAR sold by BF Goodrich Chemical Company of Cleveland, Ohio. The backing sheet before impregnation may have a weight of about 12–16 lbs per 1,300 $ft^2$; the impregnated paper may have a weight of about 16–20 lbs per 1,300 $ft^2$ and a thickness of 3–5 mils ±0.5 mil.

The backing sheet may be coated with a barrier coat to seal the underlying paper sheet and to allow release of the heat release layer from the backing sheet. The barrier coating on the top surface of the backing sheet prevents penetration of the heat release layer into the fibers of the backing sheet. Useful barrier coating compositions may comprise a polymeric binder and a clay mixture, for example. One suitable barrier coating contains a mixture of 25–50 parts by weight of a polymeric acrylic latex with 100 parts by weight of clay. Suitable acrylic polymers include self-crosslinking polymers which are supplied commercially as nonionic latexes. Other suitable polymeric binders include butadiene-styrene, butadiene-acrylonitrile and polyvinylacetate polymers which may also be combined with clay to form a satisfactory barrier coating on the backing sheet. The barrier coat may be applied at a ratio of 3–5 lbs. per 1300 $ft^2$ of the backing sheet.

A heat release layer is formed over the backing sheet or the backing sheet having a barrier coating. The heat release layer may be a single layer or a plurality of heat release layers. Suitable materials for the heat release layer include polyvinylchloride plastisols which are dispersions of a vinyl resin in a non-aqueous liquid. Suitable plastisols, their preparation and application as heat release layers are described, for example, in U.S. Pat. No. 4,037,008. The heat release layer may also be a wax layer having a melting point lower than the barrier coating layer on the backing sheet, if a barrier layer is present. Heat application to the transfer sheet melts the wax release layer allowing separation of the release layer from the backing sheet. Such wax release layers may be applied to the backing sheet using an offset role as described in U.S. Pat. No. 4,322,467. The heat release layer described in U.S. Pat. No. 4,117,182 which contains an acrylic resin or cellulosic derivative, preferably in combination with a straight chain, primary aliphatic oxyalkylated alcohol, a plasticizer and a tackifier may also be used.

In a preferred embodiment, the heat release layer is a two layer structure in which the first layer in contact with the backing sheet is a mixture of a vinyl resin and a polyethylene wax, and the second layer in contact with first layer is an ionomer polymer applied as a latex. The first layer is formed by heating the vinyl resin and wax and a solvent, such as toluene or a diluent such as odorless mineral spirits at a weight ratio of 70% solids to 30% solids, until the mixture is homogenous. When toluene is used, the mixture should be brought to a preferred temperature of from 82.2° to 96° C. in order to cause the resin to dissolve and liquify. Suitable vinyl resins are copolymers of vinyl acetate and ethylene containing about 17–33% by weight vinyl acetate and having a melt index (as measured by ASTM D1238) of from 5 to 46.5. Suitable vinyl resins will have a resin density of about 0.933 to about 0.954 $gm/cm^3$ and a ring and ball softening point as measured by ASTM E28 of about 180°–310° F. Suitable vinyl resins are commercially available as EVA 501 and EVA 505 from Union Carbide Corporation. The vinyl resin/wax mixture will generally contain 100–40 parts by weight vinyl resin and 20–80 parts wax.

Suitable polyethylene waxes are polyethylene waxes having a weight average molecular weight from about 1800 to 8000, a ring and ball softening point from about 100°–120° C., a density from about 0.906–0.964 $gm/cm^3$ at 25° C. and a viscosity from about 230–1800 cp as measured by Brookfield Viscosity, No. 3 Spindle at 6 rpm. The polyethylene waxes may be either emulsifiable or non-emulsifiable. A suitable polyethylene wax is available as EPOLENE E14 from Eastman Chemical Products of Kingsport, Tenn.

The vinyl resin and polyethylene wax are blended together in heated solvent to form a hot clear solution which is uniformly applied over the backing sheet using any conventional coating method such as an air knife, gravure roller or wire rod applicator. The first layer is preferably applied at about 3–10 lbs. per 1300 $ft^2$.

The second layer of ionomer polymer is applied over the first layer, preferably as a latex containing about 30% by weight polymer and 80% by weight water. Suitable ionomer dispersions are commercially available as 56220 SURLYN, 56230 SURLYN and 56256 SURLYN from E. I. DuPont. Ethylene-acrylic acid copolymers having an acrylic acid content of about 17–20% by weight and a melt index of from about 300 to 500 may also be used as the ionomer polymer. If it is desired to extrude the second layer onto the first layer, and ethylene-acrylic acid copolymer containing about 3–15% by weight acrylic acid and having a melt index of about 2–11 can be used. The second layer is preferably applied at a rate of about 1–4 lbs. per 1300 $ft^2$.

This type of heat release layer is fully described in U.S. Pat. No. 4,235,657. A suitable backing sheet having disposed thereon one or more heat release layers is commercially available as ULTIMA from Kimberly-Clarke Company.

An ink design layer is applied over the heat release layer. The ink design layer may be applied by a conventional printing process, including application of halftone and color separations to the heat release layer by lithographic offset printing or other standard surface-to-surface printing processes. The halftone or full color processes may utilize standard air-drying process inks or latex-based air-drying inks. Printing may be conducted as a positive or negative image.

Suitable ink designs can be obtained on the ink design layer using standard lithographic inks. The inks should be selected so that the inks are compatible with the later heat treatment which is necessary to transfer the image to the substrate. Heat resistant inks are, therefore, preferred. Drying speed can be improved by modifying the ink compositions to use a low quantity of drying oils and/or fast drying oils. The inks should also be selected such that the inks of the color separations are compatible with each other and with subsequent heat processing in order to produce an accurate sharp ink design.

Suitable inks having the properties identified above can be prepared by combining conventional red (rhodamine), yellow (benzedrine), blue (cyan) and black (process black) inks with an ink vehicle containing suitable resins and drying oils. A preferred ink vehicle contains 5–20 wt. %, preferably 7–13 wt. % of a drying (oxidizing) oil alkyd resin having an acid number of 2–25, preferably 5–20 and a Gardener Holdt viscosity of Z4 to Z6 at 25° C. The alkyd resin is preferably prepared using a sufficient amount of drying oil such that the oil length of the alkyd can be classified as a long oil alkyd of 50–90 wt. %, preferably 65–80 wt. % oil content.

The preferred ink vehicle also contains one or more esters of a modified rosin or polymerized rosin acid in an amount of about 5–30 wt. %, preferably 10–25 wt. %. These esters will generally have a melting point of about 120°–220° C., preferably 140°–190° C. and an acid number of 5–35, preferably 8–25. In a particularly preferred embodiment, two pentaerythritol esters of modified rosin and polymerized rosin acids are used, 5–10 wt. % of a first ester having a melting point of 140°–155° C. and an acid number of 8–25, and 5–15 wt. % of a second ester having a melting point of 175°–190° C. and an acid number of 8–17.

Finally, the ink vehicle contains one or more drying oils in an amount of 2–15 wt. %, preferably 4–8 wt. %. Suitable drying oils include linseed oil, tung oil, etc., and mixtures thereof. Ink oils, preferably high boiling petroleum hydrocarbon fractions, are preferred solvents for the ink vehicle. Such ink oils are well known and generally have a boiling point range from about 200°–300° C., preferably 225°–275° C. and a K.B. value of 20–35, preferably 24–30. The ink oils and drying oils solubilize the alkyd resin enabling smooth application of the ink-containing vehicle with conventional lithographic offset printing equipment.

A polymer layer containing a water dispersible polymer is then applied over the ink design layer. The polymer layer may be applied by any suitable coating process. Conveniently, the polymer layer is applied as an aqueous dispersion from a conventional coating tower suitable for use with lithographic offset printing equipment. The aqueous polymer coat formed by this process may be air-dried or, preferably is dried using a conventional infrared dryer. Infrared drying enables faster production of the intermediate sheets having the backing sheet, heat release layer, ink design layer and polymer layer, without the sheets sticking to one another. While not being bound by any particular theory, it is believed that the polymer layer prevents oxygen from diffusing from the atmosphere into the underlying ink in the ink design layer. The polymer layer, therefore, physically protects the underlying ink design from scratching or abrasion and improves the shelf life or storage time of the transfer sheet by preventing oxidation of the lithographic inks in the ink layer. The ink colors in the ink layers remain strong and vibrant so that the ink design produced after storing the transfer sheet for as long as 1–2 years is substantially the same as the ink design obtained from immediate use of the transfer sheet. Long storage times are economically important as it is not necessary to discard transfer sheets in which the ink has become oxidized and of poor quality and color.

The polymer layer is suitably applied as an aqueous dispersion of the water-dispersible polymer. Suitable water-dispersible polymers are copolymers of α,β-unsaturated carboxylic acid esters and a copolymerizable comohomer. Preferred carboxylic acid esters contain 4–10, preferably 3–7 carbon atoms. The acid portion of the ester is preferably acrylic acid or methacrylic acid. The alcohol portion of the ester is preferably an alcohol having 1–7 carbon atoms. Preferred esters include esters of acrylic acid and methacrylic acid, such as methyl methacrylate, ethyl acrylate, propyl acrylate and butyl acrylate.

Suitable polymerizable comonomers include $C_{1-6}$ olefins, preferably α-olefins including ethylene, propylene, butylene, etc. and $C_{8-15}$ vinyl aromatic compounds including styrene, methylstyrene, p-methylstyrene, etc.

The water-dispersible polymer will generally have a Tg of 25°–35° C., preferably 25°–30° C. in order to enable a smooth coating of the polymer layer over the ink layer at relatively low temperatures. The water-dispersible polymer may, for example, contain methyl methacrylate, butyl acrylate and styrene monomers, the relative proportion of which is adjusted to obtain a suitable Tg. The amount of styrene is generally adjusted to provide a polymer which has little or no yellowing when exposed to light. The polymer may also contain up to about 5 wt % acrylic acid which is generally neutralized by the addition of ammonia or an organic amine to improve water-dispersibility. The aqueous polymer dispersion will generally have a pH of about 7–9, preferably 8–8.5.

Suitable aqueous polymer dispersions or emulsions are commercially available for coating graphic arts paper or paper board with an in-line coater. The aqueous polymer dispersion is applied at a rate of 0.5–6.0, preferably 1.5–5.0 lbs per 1300 $ft^2$. A suitable aqueous polymer emulsion is sold under the trade designation CORK-KOTE 43P-45 of Cork Industries, Inc., Folcroft, Pa.

The mask layer is applied over the polymer layer using a conventional printing process, preferably a conventional screen printing process. The mask layer is printed over the polymer layer such that the mask outlines one or more ink designs present in the ink design layer. That is, the mask circumferentially defines the outer boundary of each ink design which will be transferred during the heat transfer process. A plurality of ink designs may be present on a single transfer sheet, where the mask layer simultaneously defines the boundary of each ink design. Preferably, the mask is applied to the polymer layer so that the mask covers the entire transfer sheet except the portion of the transfer sheet within the outline circumscribing the ink design or designs which will be transferred. The mask layer does not cover the ink design within the outline, that is, the mask layer is not present on the polymer layer within the outline of the ink design. Application of sufficient heat through the backing sheet transfers the polymer layer, ink design layer and heat release layer through the mask onto the substrate.

The mask layer is, preferably, a thermosetting lacquer composition which fuses with the underlying polymer layer, ink layer and heat transfer layer when heat is applied to the transfer sheet, thereby preventing transfer of any portion of the transfer sheet which is covered by the mask layer. The mask layer is non-adhesive to the substrate and prevents formation of a polymer halo on the substrate.

The mask layer can be formed from a conventional industrial screen ink lacquer. The composition of the industrial lacquer may be varied widely and is not particularly limited so long as the lacquer is non-adhesive to the substrate and bonds to the underlying polymer layer, preventing heat transfer of the underlying layer. The industrial lacquer is preferably a polymeric, crosslinked resin material which may, optionally, contain a solid filler or pigment. Suitable crosslinked polymeric materials include epoxy-polyesters, epoxy-polyamides, polyisocyanate/polyester mixtures, polyisocyanate/polyol mixtures, urethane/acrylic mixtures. The mask may be opaque or transparent, or may contain a pigment or filler to impart a desired color. Preferably, the mask is clear or opaque to avoid any possibility of color transfer to the substrate during the heat transfer process.

The industrial lacquer used to form the mask layer may contain two or more crosslinkable polymeric components which react together to form the crosslinked mask layer. For example, a first component such as polymethyl polyphenylisocyanates, aromatic and aliphatic polyisocyanate prepolymers, toluene diisocyanate based adducts, copolymers of aromatic and aliphatic polyisocyanates, toluene polyisocyanurate, polyfunctional aliphatic isocyanates, blocked isocyanate prepolymers, 2,4-toluene diisocyanates, prepolymers of diphenyl methane L0 diisocyanates, epoxy and oxirane resins may be combined with a second component such as hydroxyl terminated castor oils, hydroxyl terminated linear and branched polyesters, acrylic resins and reactive polyamides to form a suitable crosslinkable thermosetting lacquer. The ratio of the first component to the second component is about 80–20 parts by weight to about 40–80 parts by weight, respectively. If desired, an organic solvent such as cellulose acetate butyrate or nitrocellulose solution may be used to dissolve the first and second lacquer components. The industrial screen ink lacquer of the mask layer is generally applied as a solution or dispersion in an organic solvent. Typically, the solvent constitutes about 10–80 parts by weight of the solution or dispersion. Acceptable solvents include alkyl, aryl and aralkyl ethers, aliphatic and aromatic hydrocarbons, as well as alkyl, aryl and aralkyl alcohols. Suitable lacquers are well known in the art and described, for example, in U.S. Pat. No. 3,959,555, U.S. Pat. No. 4,517,044, etc. Preferred industrial screen ink lacquers are available in the IL-000 series (tradename) of Nazdar Company, Chicago, Ill. which contain about 25–45 wt. % 2-butoxyethanol, 0–35 wt. % pigments, 10–20 wt. % resin material, 5–10 wt. % isopropanol, 0–16 wt. % petroleum distillates containing aromatic hydrocarbons, 0–6 wt. % crystalline silica, less than 4 wt. % toluene and 0–2 wt. % naphthalene.

The laminated image transfer sheet of the invention has industrial applicability and is used to transfer an ink design to a porous, semiporous or non-porous substrate. The process and transfer sheet of the present invention are capable of transferring an ink design to any substrate which is stable to the thermal conditions necessary to perform the heat transfer. Suitable substrates include wood, heat stable plastics, canvas, leather, porcelain, glass, metal, natural and synthetic textiles containing natural fibers such as cotton and wool, synthetic fibers such as polyesters, polyamides (e.g., nylons), cellulosics, acrylics, etc., and mixtures thereof. The process is particularly suitable for transferring images to 100% cotton fabrics and cotton fabrics mixed with synthetic fibers such as polyester and nylon. The synthetic fiber may be present in the mixed fabric in amounts generally ranging from about 10–90% by weight, preferably about 30–80 wt %. The substrate may be in the form of a garment (hats, shoes, boots, pants, jackets, belts, etc.) patches which can be shown onto such garments or other articles onto which a design may be applied (keychains, wallets, saddles, purse, handbags, backpacks, etc.) The form of the substrate is not limited so long as a suitable surface is available for accepting the transferred design.

In the process of the present invention, the transfer sheet is placed in contact with the substrate in such a manner that the mask layer contacts the substrate. Heat and pressure are then applied through the backing sheet using a conventional heated platen press. The temperature at which the temperature is applied and the length of time during the heat and pressure application depend upon the nature of the substrate and the specific method of heat application. Temperatures ranging from about 250°–450° F., preferably 350°–400° F., are convenient and allow for the use of a wide variety of thermally stable lithographic offset inks. The applied pressure preferably varies from about 30 to 120 lbs per square inch (psi) and is generally applied for a contact time ranging from about 2–30 seconds, preferably about 5–15 seconds. The time and temperature should be sufficient to effect a complete transfer of the ink design without scorching the substrate and without altering the ink design image. Heat transfer is conveniently effected using a pneumatic heat transfer press, for example, Model 720 of Insta-Graphics Systems.

In practical application, the transfer sheet is placed in contact with the substrate and heated as described above. Heat passing through the backing sheet heats the industrial lacquer of the mask layer causing the mask layer to melt and bond to the polymer layer and heat release layer. After removal of the heat, the transfer sheet on the substrate is allowed to cool for a time sufficient to harden the mask layer, which is now bonded to the underlying layers. The mask layer, fused to the underlying layers, is then peeled from the substrate together with the backing sheet. The substrate having the ink design image transferred thereto is then removed from the heat press.

The ink design is transferred to the substrate together with the heat release layer and polymer layer which are in contact with and on opposite sides of the ink design in the ink design layer. When the substrate is a fabric, the polymer layer, which enters the fabric first, softens the fabric providing a soft "hand" to the fabric. The polymer layer also improves durability of the transferred image protecting the image during frequent washing cycles. The image transferred by the process of the present invention is not subject to the cracking, splitting and peeling often associated with heat transfer of images from transfer sheet in which the ink is screen printed onto the transfer sheet.

The mask layer prevents transfer of spurious ink on the transfer sheet to the substrate and further prevents transfer of any heat release layer and polymer layer which are not within the outline of the ink design formed by the mask layer. The mask layer prevents transfer of polymer layer and heat release layer which would overlap and extend beyond the ink design, thereby preventing the formation of a polymer "halo" around the ink design on the substrate. Such a polymer halo is undesirable as it reduces the soft hand of the substrate and visually detracts from the transferred ink design, reducing the sharpness and clarity of the transferred image.

Further, the transfer sheet of the invention and process using the same are environmentally safe. The transfer sheet and process of the invention overcome environmental problems associated with conventional screen printing in which substantial amounts of solvents are needed to wash the screens and in which solvent-based inks are generally used.

Other features of the invention will become apparent in the course of the following descriptions of an exemplary embodiment which is given for illustration of the invention and is not intended to be limiting thereof.

EXAMPLES

Example 1

A transfer sheet according to the present invention was prepared as follows. Aluminum lithographic printing plates were prepared by color separating a selected color design using conventional lithographic color separation techniques.

The lithographic printing plates were then mounted in a lithographic printing press into which were loaded individual backing sheets having applied thereto one or more heat release layers (ULTIMA available from Kimberly-Clarke Company,) and inks corresponding to the lithographic color separations. An aqueous polymer emulsion (CORK-COTE available from Cork, Inc.) was loaded into a conventional spray column suitable for applying a thin film of the aqueous polymer onto the ink printed sheets. The press was then run in a conventional manner printing the inks onto the paper and applying a film of the aqueous polymer dispersion which was readily dried using conventional infrared (IR) drying.

The mask layer was then applied by conventional screen printing to all portions of the printed paper with the exception of the ink design portion to complete the image transfer of the invention.

The transfer of the design from the image transfer sheet was completed by placing a 100% cotton shirt into a conventional pneumatic heat transfer press (MODEL 720 of Insta-Graphics Systems), applying heat and pressure for a time sufficient to transfer the image to the shirt and then removing the printed shirt from the heat transfer press. The fused expended transfer sheet was manually removed from the shirt to provide a printed shirt having excellent hand and a clear printed image.

Example 2

A second image transfer sheet prepared as described in Example 1 was used to transfer the design onto a sheet of leather. The leather substrate and ink transfer sheet were placed in the heat transfer press and the design was transferred to the leather substrate in the same manner as described in Example 1 to produce a leather substrate having the design thereon. The leather substrate was flexible having good hand and the image was clear and accurately transferred.

The U.S. Patents referred to in this specification are each, individually, incorporated herein by reference in their entirety.

Obviously, numerous modifications and variations to the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A laminated image transfer sheet, comprising:
   - a backing sheet;
   - a heat release layer on said backing sheet;
   - an ink design layer on said heat release layer;
   - a polymer layer containing a water-dispersible polymer on said ink design layer; and
   - a mask layer on said polymer layer, wherein said mask layer outlines an ink design in said ink design layer, but does not cover said ink design and allows transfer of only said heat release layer, said ink design and said polymer layer within said outlined ink design.

2. The transfer sheet of claim 1, wherein said backing sheet is selected from the group consisting of paper webs, plastic films, metal foils, wood pulp fiber papers, vegetable parchment papers and lithographic printing papers.

3. The transfer sheet of claim 2, wherein said backing sheet is lithographic printing paper.

4. The transfer sheet of claim 1, wherein said heat release layer is selected from the group consisting of polyvinylchlorides, waxes, acrylic resins, cellulose polymers, ionomer polymers and vinyl resin/wax mixtures.

5. The transfer sheet of claim 4, wherein said heat release layer has a two-layer structure wherein a first layer is a vinyl resin/polyethylene wax mixture and a second layer in contact with said first layer is an ionomer polymer.

6. The transfer sheet of claim 1, wherein said water-dispersible polymer is a copolymer of an $\alpha$, $\beta$-unsaturated carboxylic acid ester and a copolymerizable comonomer.

7. The transfer sheet of claim 6, wherein said carboxylic acid esters contain 4–10 carbon atoms.

8. The transfer sheet of claim 6, wherein said copolymerizable comonomer is selected from the group consisting of $C_{1-6}$ olefins and $C_{8-15}$ vinyl aromatic compounds.

9. The transfer sheet of claim 1, wherein said water-dispersible polymer has a Tg of 25°–35° C.

10. The transfer sheet of claim 1, wherein said mask layer is clear or opaque.

11. A process for heat transferring an ink image from an image transfer sheet to a substrate, comprising the steps:

contacting a substrate with the mask layer of the laminated image transfer sheet of claim 1, applying heat and pressure to the backing sheet sufficient to transfer said ink design to said substrate to form an imaged substrate, and removing said laminated image transfer sheet from said imaged substrate.

12. The process of claim 11, wherein said heat is applied at a temperature from about 250°–450° F.

13. The process of claim 11, wherein said pressure is applied from about 30°–120 psi.

14. The process of claim 11, wherein said substrate is selected from the group consisting of wood, heat stable plastics, canvas, leather, porcelain, glass, metal, natural fiber textiles and synthetic fiber textiles.

15. The process of claim 1, wherein said substrate is leather.

16. A laminated image transfer sheet, comprising:

a backing sheet;

a heat release layer on said backing sheet;

an ink design layer on said heat release layer;

a polymer layer containing a water-dispersible polymer on said ink design layer; and a mask layer on said polymer layer, wherein said mask layer outlines an ink design in said ink design layer, but does not cover said ink design and allows transfer of only said heat release layer, said ink design and said polymer layer within said outlined ink design, wherein said mask layer is a screen ink lacquer.

17. The transfer sheet of claim 16, wherein said lacquer contains a polymeric crosslinked resin.

18. The transfer sheet of claim 17, wherein said resin is selected from the group consisting of epoxy-polyesters, epoxypolyamides, polyisocyanate/polyester mixtures, polyisocyanate/polyol mixtures, polyisocyanate/acrylic mixtures, polyisocyanate/polyamide mixtures and urethane/acrylic mixtures.

19. A process for heat transferring an ink image from an ink transfer sheet to a substrate, comprising the steps:

contacting a substrate with a mask layer of the laminated image transfer sheet of claim 10, applying heat and pressure to the backing sheet sufficient to transfer said ink design to said substrate to form an imaged substrate; and removing said laminated image transfer sheet from said imaged substrate.

* * * * *